US009685716B2

(12) United States Patent
Sasano

(10) Patent No.: US 9,685,716 B2
(45) Date of Patent: Jun. 20, 2017

(54) ATTACHMENT STRUCTURE OF ELECTRONIC DEVICE

(71) Applicant: OMRON Corporation, Kyoto-shi, Kyoto (JP)

(72) Inventor: Naoya Sasano, Hachioji (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/891,079

(22) Filed: May 9, 2013

(65) Prior Publication Data

US 2013/0316552 A1 Nov. 28, 2013

(30) Foreign Application Priority Data

May 14, 2012 (JP) ..... 2012-110861

(51) Int. Cl.
*H01R 9/26* (2006.01)

(52) U.S. Cl.
CPC ..... *H01R 9/2608* (2013.01)

(58) Field of Classification Search
CPC ..... H01R 9/2608
USPC ..... 439/92–95, 532, 541.5, 700, 715–716, 439/121, 122, 352
See application file for complete search history.

(56) References Cited

U.S. PATENT DOCUMENTS

| | | | |
|---|---|---|---|
| 5,145,418 A | 9/1992 | Moranski et al. | |
| 5,192,227 A * | 3/1993 | Bales | 439/532 |
| 7,922,521 B1 * | 4/2011 | Wu | 439/532 |

FOREIGN PATENT DOCUMENTS

| | | |
|---|---|---|
| CN | 101944664 | 1/2011 |
| DE | 102 05 238 A1 | 8/2003 |
| EP | 0 608 482 B1 | 9/1993 |
| JP | S567394 | 1/1981 |
| JP | H08148860 | 6/1996 |

OTHER PUBLICATIONS

Chinese Office Action, issued Feb. 11, 2015, for corresponding Chinese Patent Application No. 201310169631.1 (Office Action in Chinese language with English-language translation.).
Japanese Office Action, issued Feb. 22, 2016, for corresponding Japanese Patent Application No. 2012-110861. (Office Action in Japanese language with English-language machine translation.).

* cited by examiner

*Primary Examiner* — Renee Luebke
*Assistant Examiner* — Paul Baillargeon
(74) *Attorney, Agent, or Firm* — Klarquist Sparkman, LLP

(57) ABSTRACT

The present invention provides an attachment structure of an electronic device which reduces the working man-hour and the electronic device is easily detached. Therefore, the attachment structure of the electronic device is to detachably latch latching claw portions provided on a lower surface of a base of a connector terminal platform onto latching ribs of a DIN rail. Particularly, in leading ends of elastic arm portions extending from the base, the latching claw portions capable of being latched onto the latching ribs of the DIN rail are provided, and operation receiving portions for elastically deforming the elastic arm portions by a push-down operation are provided. By pushing down the operation receiving portions and elastically deforming the elastic arm portions, a latching state of the latching claw portions latched onto the latching ribs of the DIN rail can be cancelled.

10 Claims, 14 Drawing Sheets

ATTACHMENT STRUCTURE OF ELECTRONIC DEVICE

CROSS REFERENCE TO RELATED APPLICATION

This application claims the benefit of priority from Japanese Patent Application No. 2012-110861, filed on May 14, 2012, the entire contents of which is incorporated herein by reference.

BACKGROUND

The present invention relates to an attachment structure of an electronic device, particularly to an attachment structure of an electronic device attachable to and detachable from a support rail.

Conventionally, as an attachment structure of an electronic device, for example, a plastic foot to be detachably latched onto two latching ribs of a support rail via an elastic leg portion and a support portion of an electronic device is disclosed (refer to EP0608482B1).

However, with the above attachment structure of the electronic device, after an operation jig such as a screw driver is inserted toward an elastic leg portion 8 shown in the drawings of EP0608482B1, there is a need for bringing the operation jig down to the side of a support rail 2 and twisting the elastic leg portion 8. Therefore, there is a problem that the working man-hour required for detaching the electronic device is large and troublesome.

SUMMARY

An object of the present invention is to provide an attachment structure of an electronic device which reduces the working man-hour and the electronic device is easily detached.

In accordance with one aspect of the present invention, in order to solve the above problem, an attachment structure of an electronic device includes a latching claw portion provided on a lower surface of a base of the electronic device and a latching rib of a support rail, the latching rib for being latched by the latching claw portion during a latching state; and an operation receiving portion comprising an elastic arm deformable by a push-down operation of the operation receiving portion; wherein the latching claw portion and the operation receiving portion are provided in a leading end of the elastic arm portion extending from the base; and wherein the latching state is released by said pushing down operation.

According to the present invention, the latching state of the latching claw portion can be cancelled only by the push-down operation, and the electronic device can be detached by one-touch operation. Thus, the simple attachment structure of the electronic device with which the working man-hour is small is obtained.

In an embodiment of the present invention, among four corner portions of the base of the electronic device, at least in a corner portion on the one end side of the base, the elastic arm portion with the latching claw portion and the operation receiving portion for elastically deforming the elastic arm portion may be provided.

According to this embodiment, there is no need for providing a pair of elastic arm portions. Thus, the attachment structure of the electronic device having a large support force is obtained.

In an another embodiment of the present invention, wherein the latching claw portion and the operation receiving portion are disposed at an intermediate position of facing side surfaces of the base.

According to this embodiment, the electronic device can be not only attached in parallel to the support rail but also attached in the orthogonal direction. Thus, the highly versatile attachment structure of the electronic device is obtained.

In still another embodiment of the present invention, the operation receiving portion may be provided so as to be pushed down via a guide groove, provided on an outside surface of the base.

According to this embodiment, the operation receiving portion can be pushed down via the guide groove. Thus, the attachment structure of the electronic device with which a detachment operation is easily performed, is obtained.

In an another embodiment of the present invention, the operation receiving portion may be exposed from an upper surface edge of the base and is visible.

According to this embodiment, while viewing the operation receiving portion, the push-down operation can be performed. Thus, the attachment structure of the electronic device for giving a feeling of security to a worker is obtained.

In still another embodiment of the present invention, the operation receiving portion may protrude sideways from an outside surface of the base and elastically deform the elastic arm portion by the push-down operation.

According to this embodiment, the operation receiving portion can be pushed down by an operation jig such as a screw driver along the outside surface. Thus, there is an effect that a detachment task is easily performed and freedom of design is extended.

DETAILED DESCRIPTION

Figure 1A:
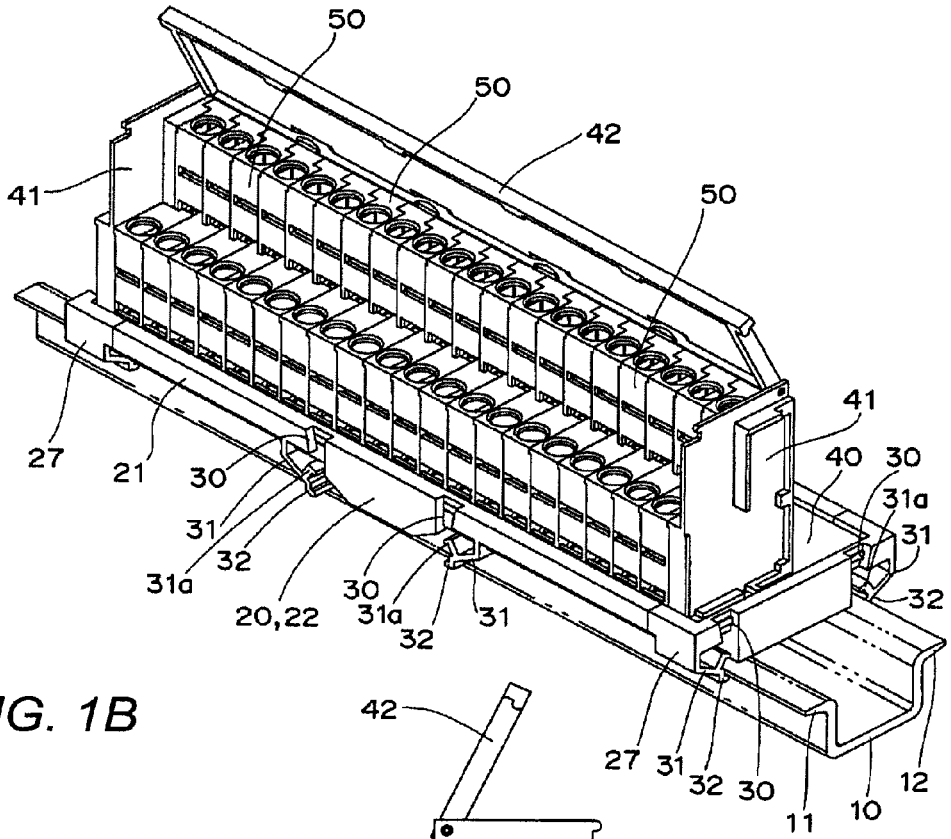
FIG. 1A is a perspective view and FIG. 1B is a left side view showing a first embodiment of an electronic device according to the present invention.

An attachment structure of an electronic device according to the present invention will be described in accordance with the drawings of FIGS. 1A to 14.

A first embodiment is a case of application to a connector terminal platform 20 attachable and detachable along or orthogonal to a DIN rail 10 as shown in FIGS. 1A to 5B.

In the DIN rail 10, latching ribs 11, 12 respectively protrude sideways from opening edges of a U shape section, so that the connector terminal platform 20 as described later can be installed.

The connector terminal platform 20 includes a base 21 formed by assembling terminal blocks 27 at both ends, a printed circuit board 40 assembled so as to cover an upper surface opening of the base 21, side surface covers 41, standing on the printed circuit board 40 so as to face each other with a predetermined gap, an upper surface cover 42 whose ends are placed on upper end corner parts of the side surface covers 41, the upper surface cover being turnably assembled, and a plurality of terminal platform blocks 50 mounted on the printed circuit board 40 and adjacently arranged between the side surface covers 41.

The base 21 has contact portions 22 abuttable with the latching ribs 11, 12 of the DIN rail 10 in outside surface center parts thereof facing each other, and guide grooves 30 are provided on both sides of the contact portions 22. In the base 21, a pair of elastic arm portions 31 extends toward the contact portions 22 from a lower surface edge thereof. In a leading end portion of the elastic arm portion 31, an operation receiving portion 31*a* operable via the guide groove 30 and a latching claw portion 32 capable of being latched onto the latching ribs 11, 12 of the DIN rail 10 are provided.

Figure 1B:
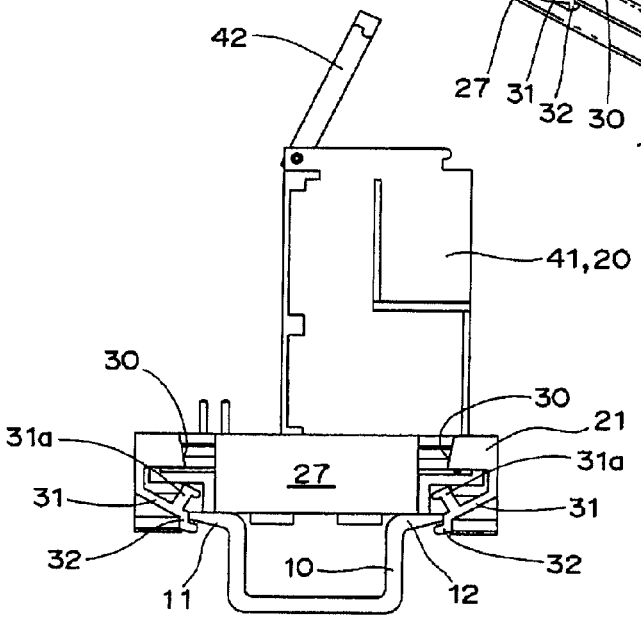

In the terminal blocks 27, as shown in FIG. 1B, the pair of guide grooves 30 are provided on side end surfaces thereof, and the pair of elastic arm portions 31 respectively extends toward a center from a lower surface edge thereof. In the leading end portion of the elastic arm portion 31, the operation receiving portion 31*a* operable via the guide groove 30 and the latching claw portion 32 capable of being latched on the latching ribs 11, 12 of the DIN rail 10 are provided.

In the case where the connector terminal platform 20 is attached along the DIN rail 10, the base 21 is positioned in parallel to the DIN rail 10, and by pushing the operation receiving portion 31 a from upper side, i.e., from the electronic device side to the rail side, the elastic arm portions 31 provided in the terminal blocks 27 are elastically deformed. After the latching claw portions 32, 32 respectively get over the latching ribs 11, 12 of the DIN rail 10, the elastic arm portions 31 are elastically returned to the original shape, and the latching claw portions 32, 32 are respectively latched onto the latching ribs 11, 12.

Therefore, the connector terminal platform 20 is supported on the DIN rail 10 by the four elastic arm portions 31. Since the contact portions 22 of the base 21 is abuttable with the latching ribs 11, 12 of the DIN rail 10 from the side, drop-off can be more reliably prevented.

Figure 2A:
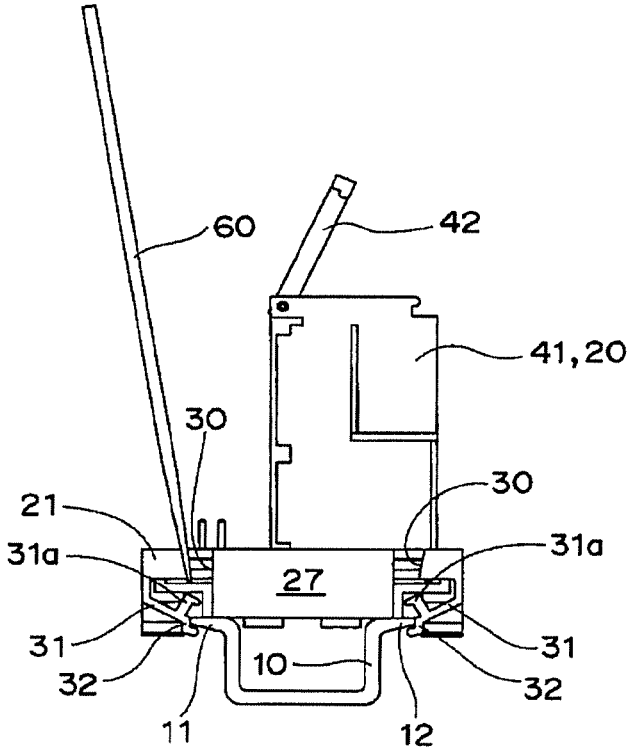
FIGS. 2A and 2B are left side views for illustrating a method for detaching the electronic device shown in FIGS. 1A and 1B.
Figure 2B:
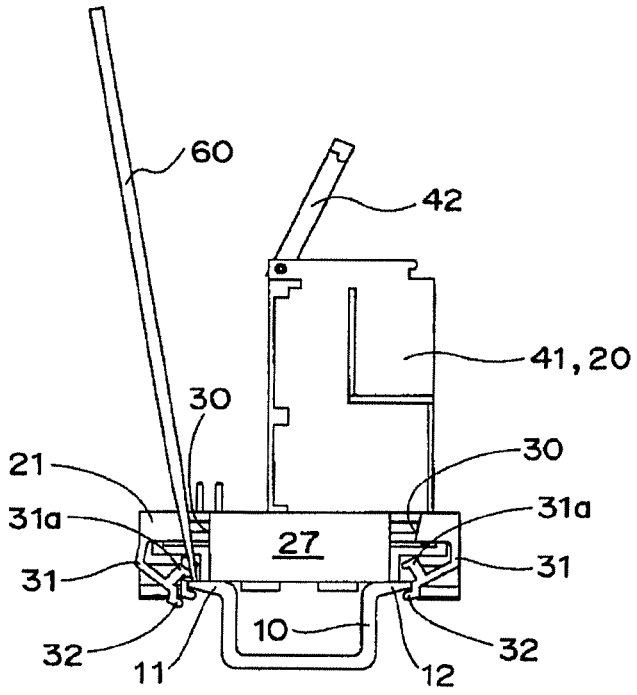
Figure 3:
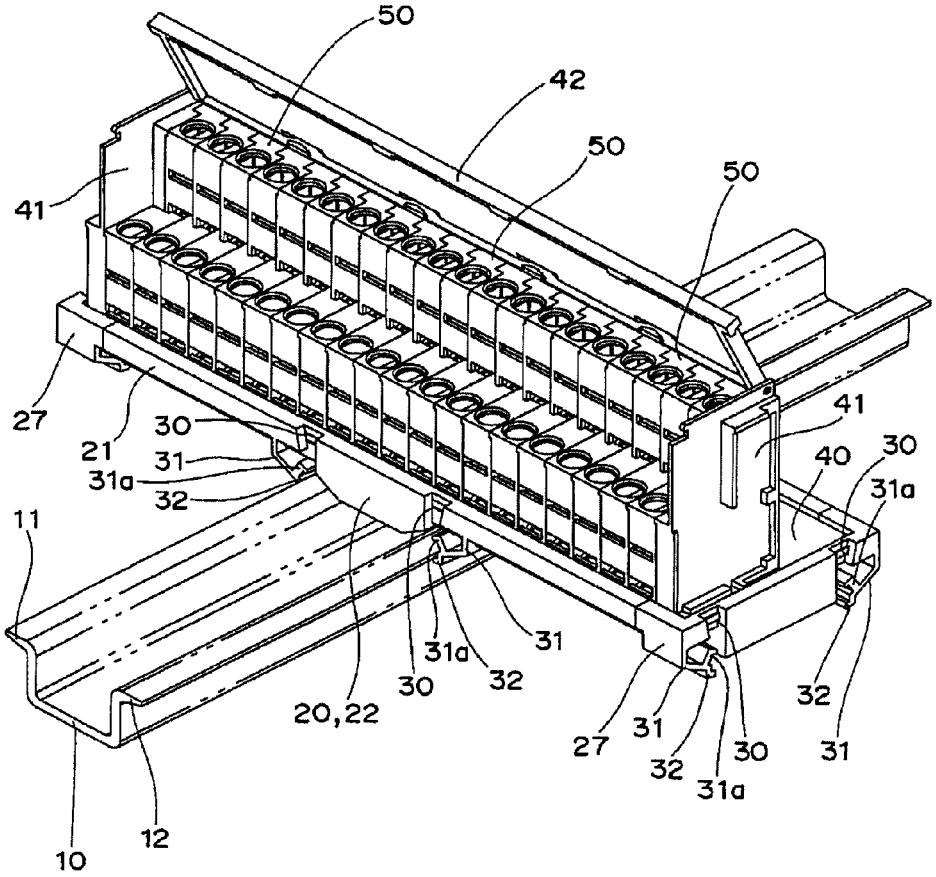
FIG. 3 is a perspective view showing a different method for attaching the electronic device shown in FIGS. 1A and 1B.

In the case where the connector terminal platform 20 attached along the DIN rail 10 is detached, as shown in FIGS. 2A and 2B, a leading end of a screw driver 60 is inserted into the guide groove 30 provided in the terminal block 27 (FIG. 2A) and the operation receiving portion 31*a* of the elastic arm portion 31 is pressed. Therefore, the elastic arm portion 31 is elastically outward deformed and the latching claw portion 32 is removed from the latching rib 11 of the DIN rail 10 (FIG. 2B), so that the connector terminal platform 20 can be detached from the DIN rail 10.

Figure 4:
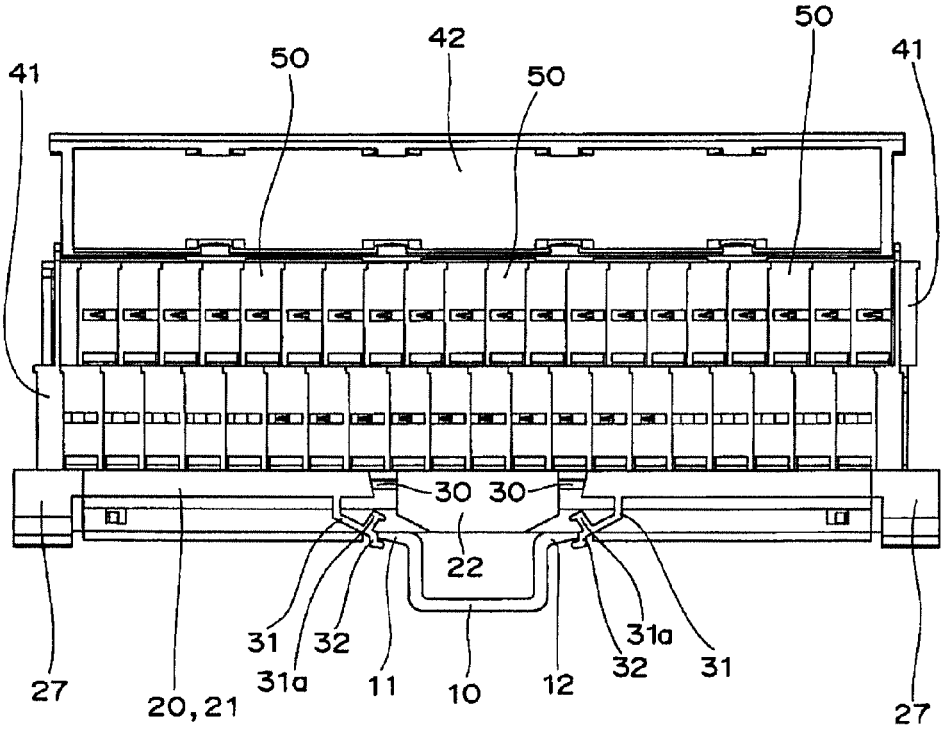
FIG. 4 is a front view of the electronic device shown in FIG. 3.

Further, as another use of the above described first embodiment, as shown in FIGS. 3 to 5B, there is a method for attaching the connector terminal platform 20 orthogonally to the DIN rail 10. That is, the contact portions 22 of the base 21 are positioned orthogonally to a sectional center of the DIN rail 10 and pushed in from the upper side. Thereby, the elastic arm portions 31 are elastically deformed. After the latching claw portions 32 get over the latching ribs 11, 12 of the DIN rail 10, the elastic arm portions 31 are elastically returned to the original shape. Therefore, the latching claw portions 32 are latched onto the latching ribs 11, 12 (FIG. 4).

Figure 5A:
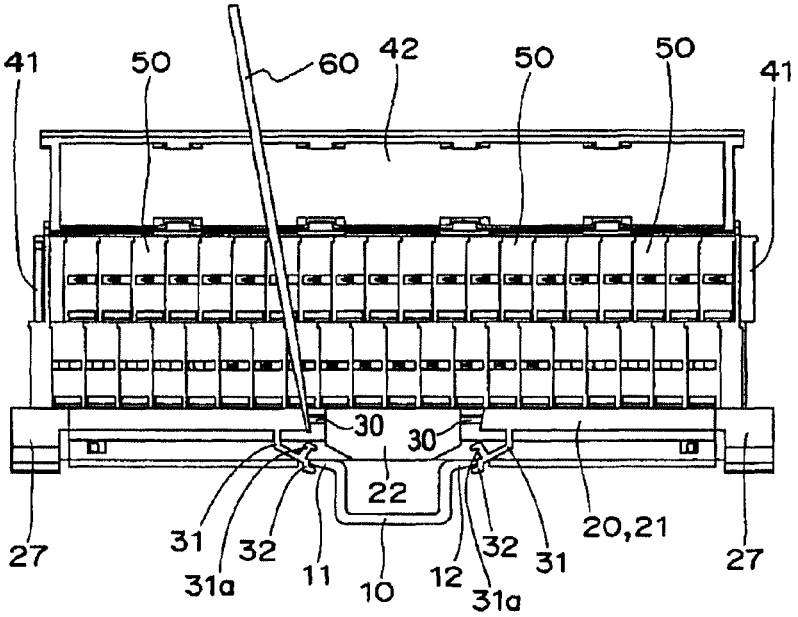
FIGS. 5A and 5B are front views for illustrating the method for detaching the electronic device shown in FIG. 4.
Figure 5B:
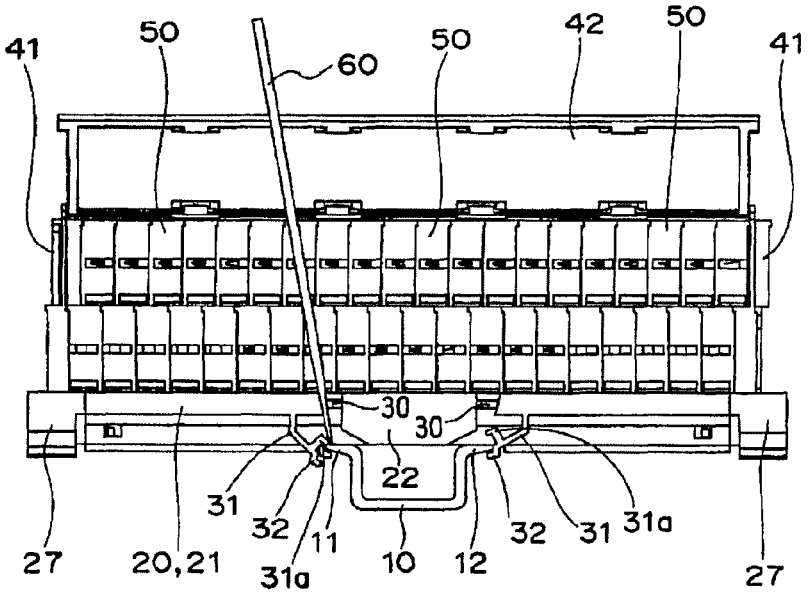
Figure 6A:
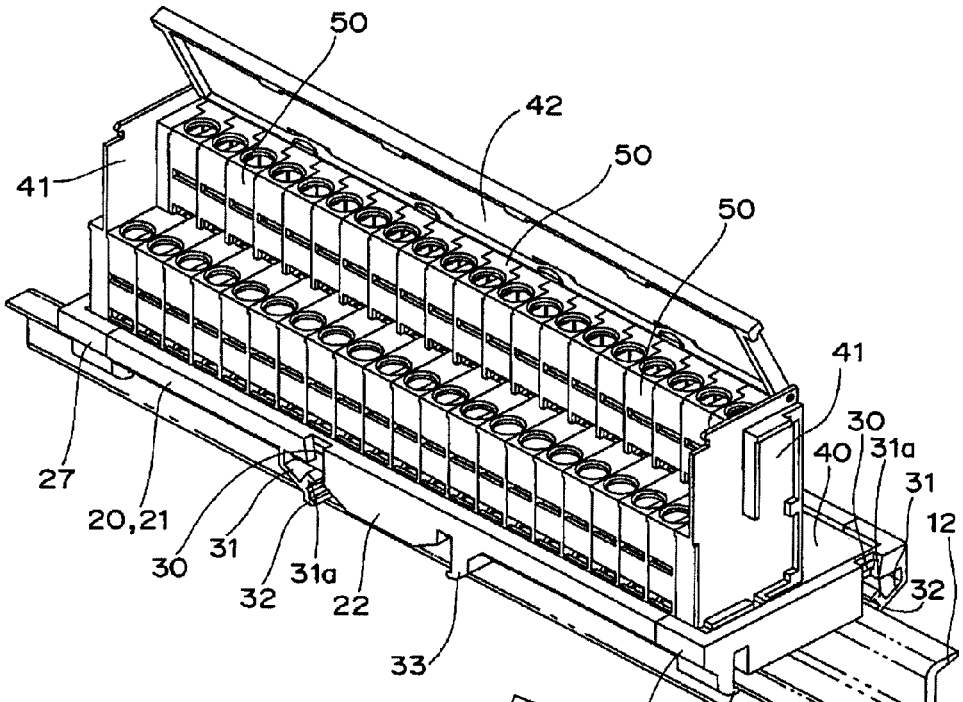
FIG. 6A is a perspective view and FIG. 6B is a left side view showing a second embodiment of an electronic device according to the present invention.
Figure 6B:
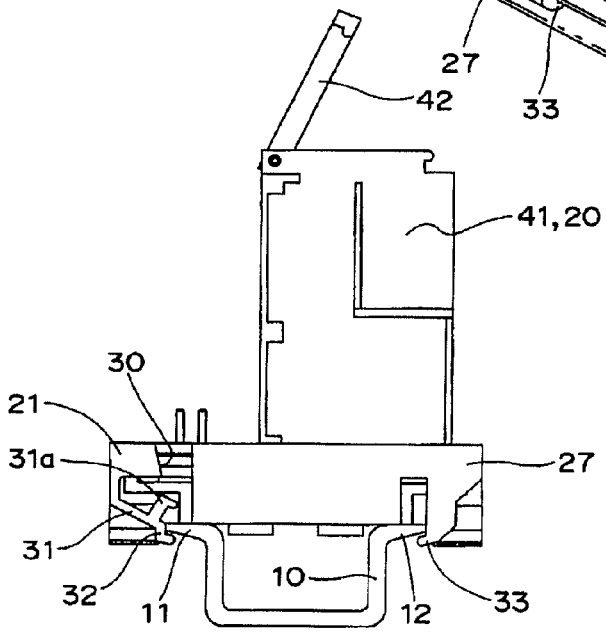
Figure 7:
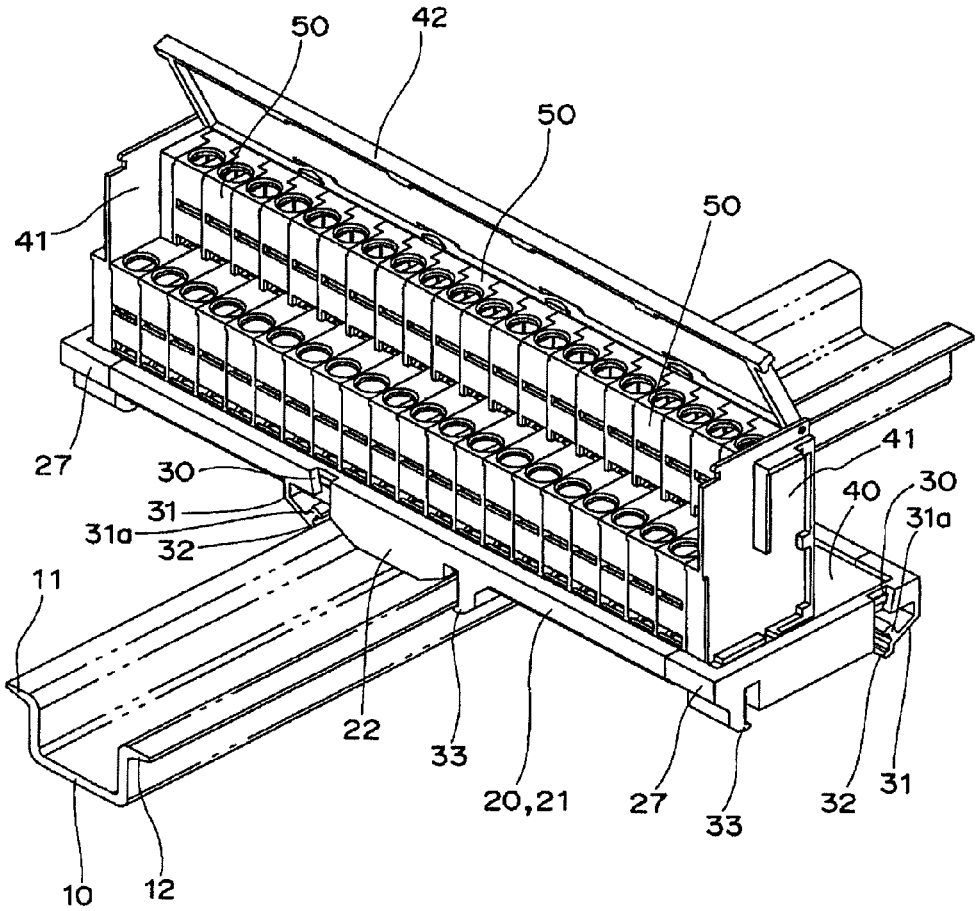
FIG. 7 is a perspective view showing a different method for attaching the electronic device shown in FIGS. 6A and 6B.
Figure 8:
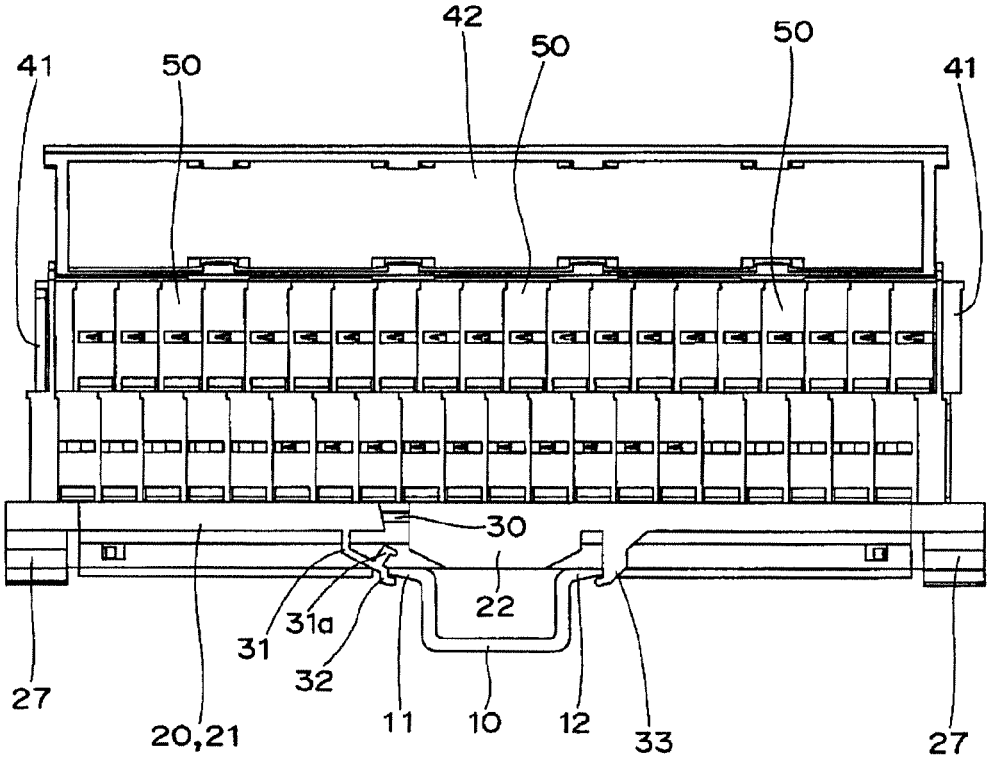
FIG. 8 is a front view of the electronic device shown in FIG. 7.
Figure 9A:
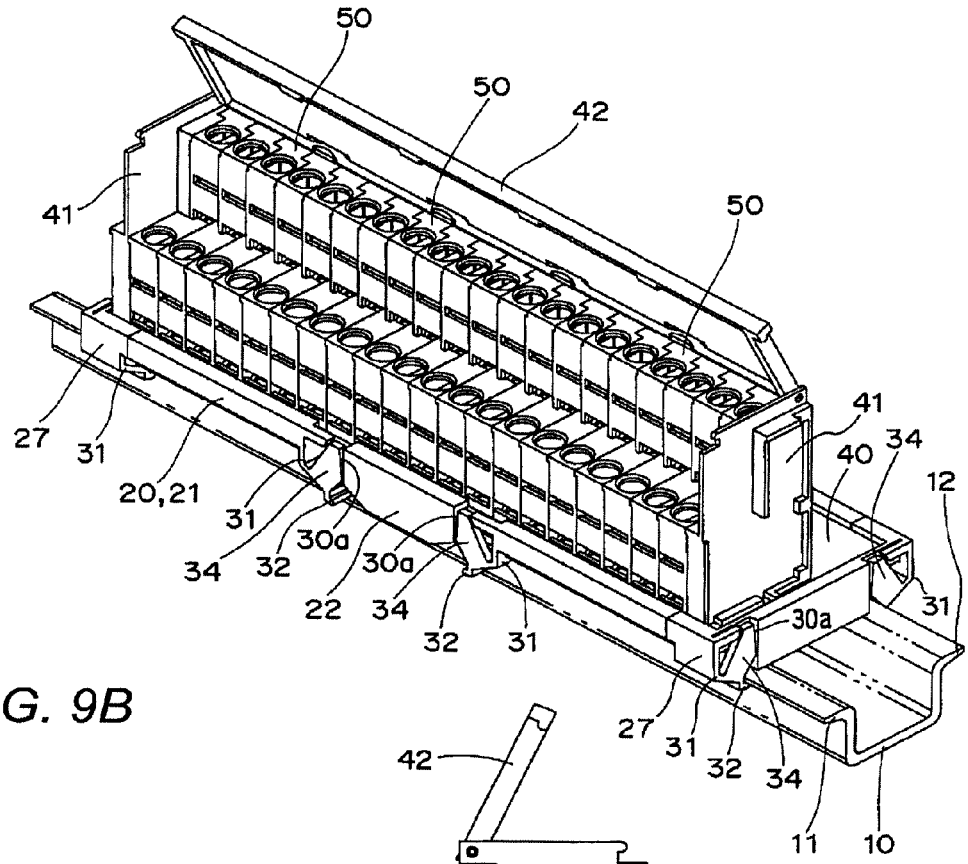
FIG. 9A is a perspective view and FIG. 9B is a left side view showing a third embodiment of an electronic device according to the present invention.
Figure 9B:
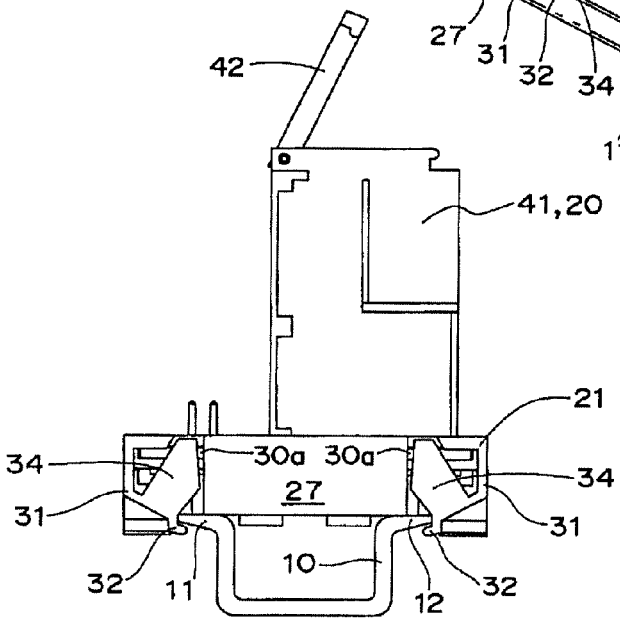
Figure 10:
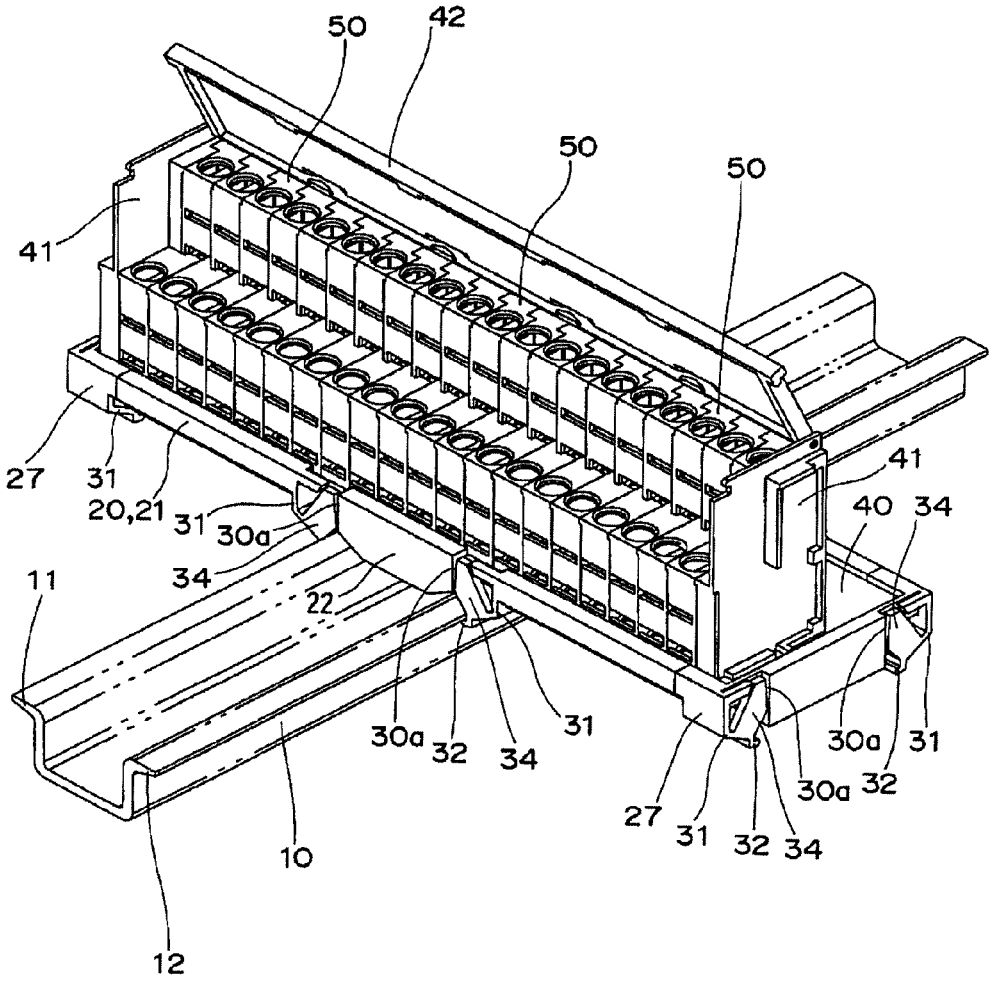
FIG. 10 is a perspective view showing a different method for attaching the electronic device shown in FIGS. 9A and 9B.
Figure 11:
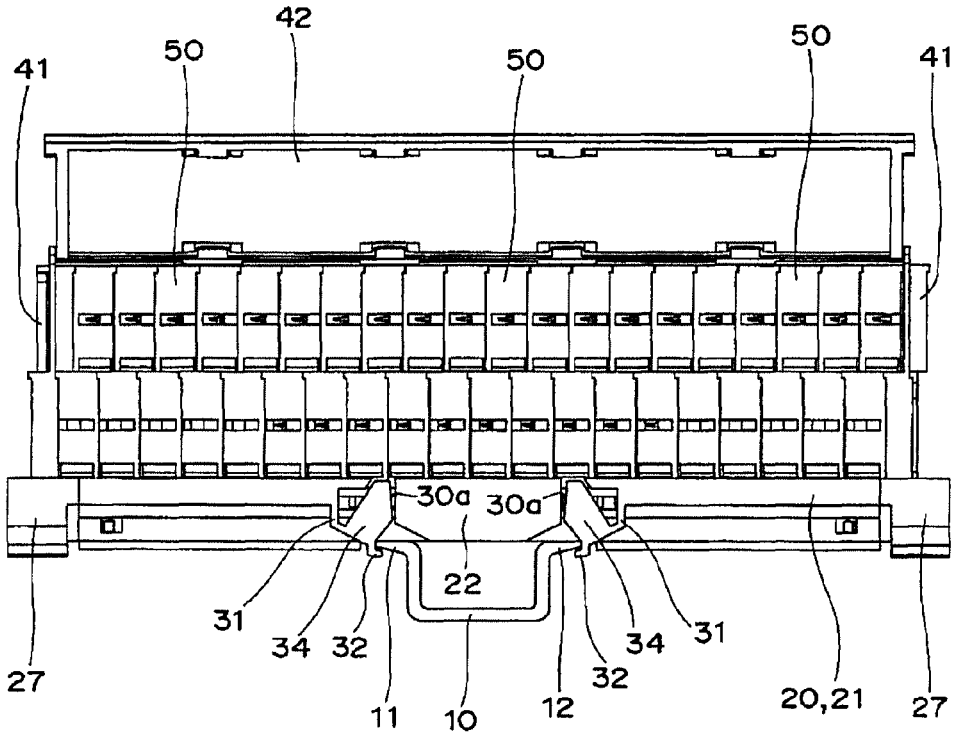
FIG. 11 is a front view of the electronic device shown in FIG. 10.
Figure 12A:
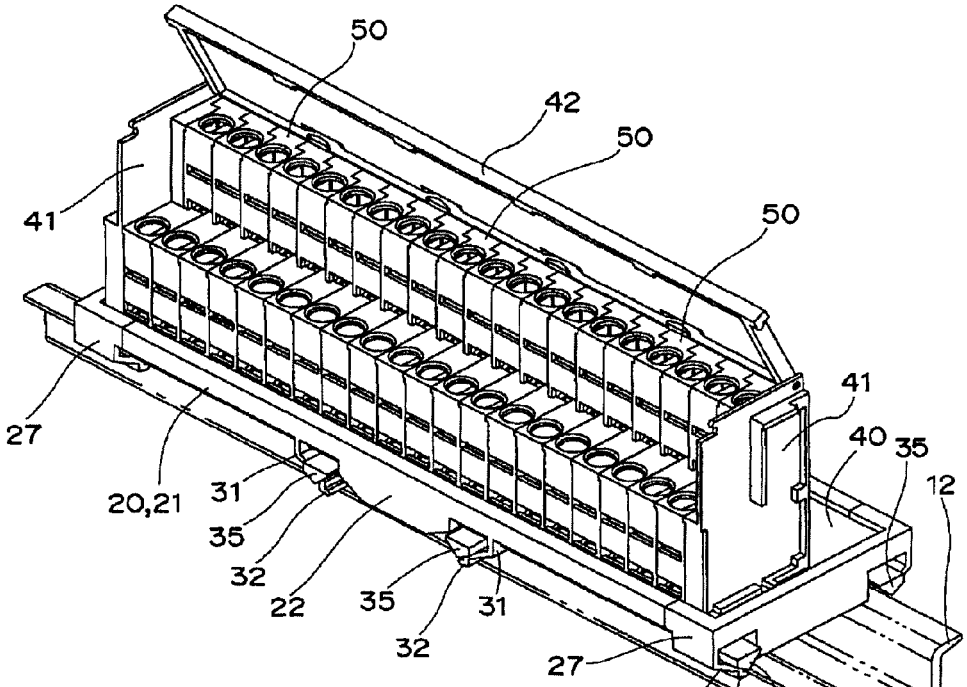
FIG. 12A is a perspective view and FIG. 12B is a left side view showing a fourth embodiment of an electronic device according to the present invention.
Figure 12B:
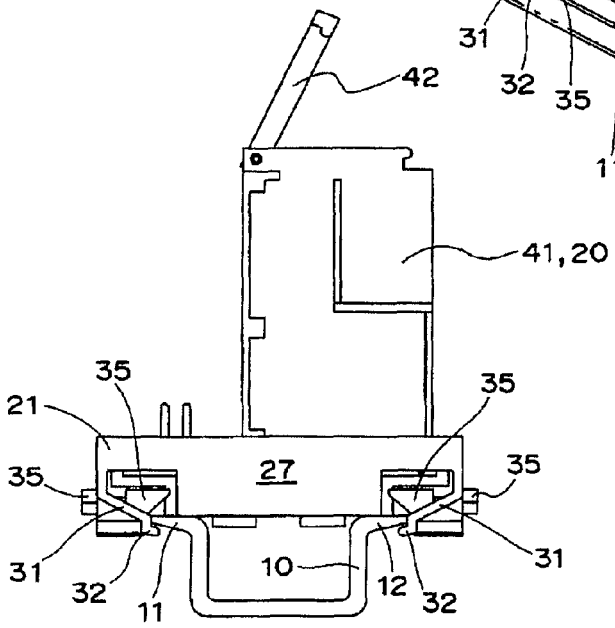
Figure 13:
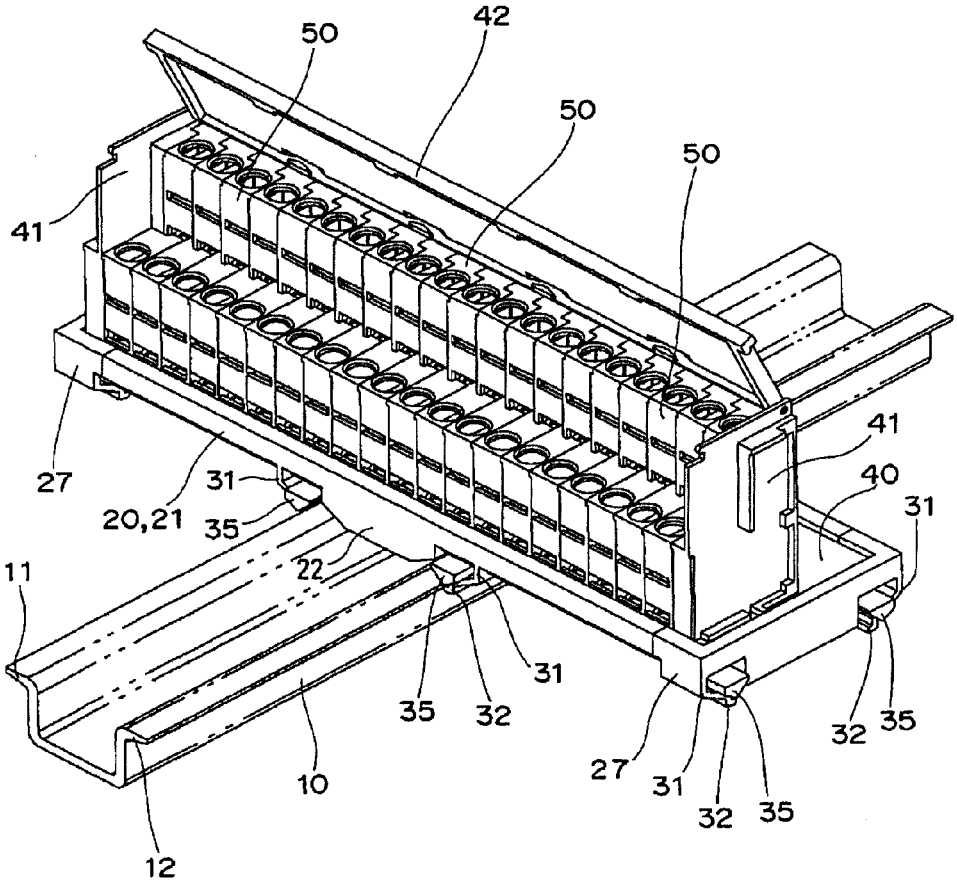
FIG. 13 is a perspective view showing a different method for attaching the electronic device shown in FIGS. 12A and 12B.
Figure 14:
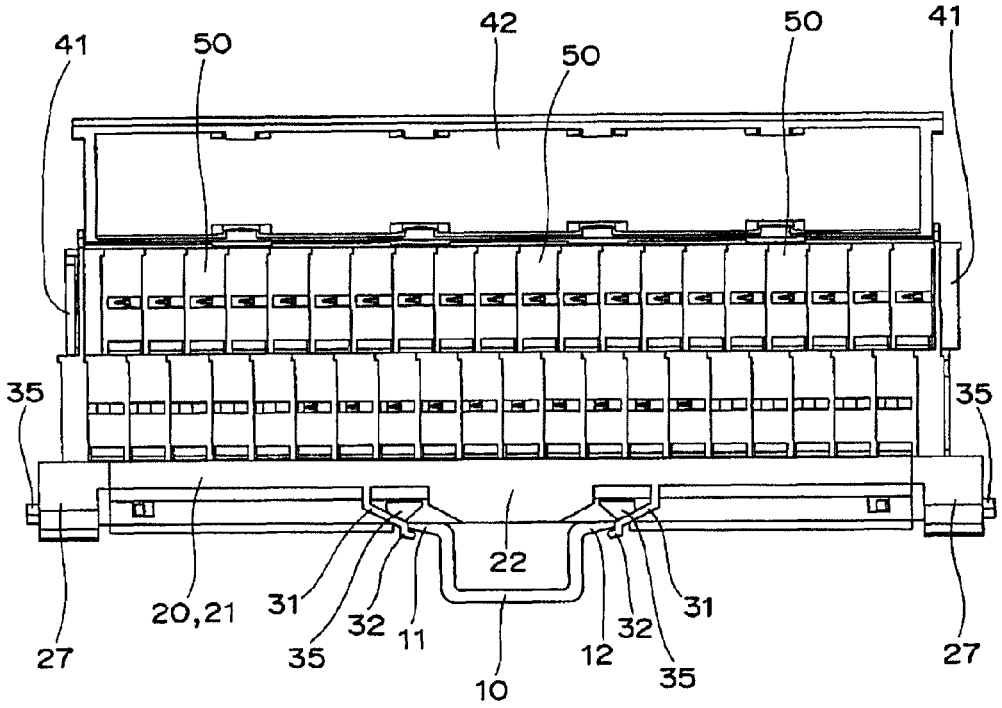
FIG. 14 is a front view of the electronic device shown in FIG. 13.

In the case where the connector terminal platform 20 is detached from the DIN rail 10, as shown in FIGS. 5A and 5B, the screw driver 60 is inserted into the guide groove 30 (FIG. 5A), the operation receiving portion 31*a* extending from the elastic arm portion 31 is pressed, and the elastic arm portion 31 is elastically outward deformed. Thereby, the latching claw portions 32 are removed from the latching ribs 11, 12 of the DIN rail 10 (FIG. 5B), so that the connector terminal platform 20 can be detached from the DIN rail 10.

A second embodiment is substantially the same as the above first embodiment as shown in FIGS. 6A to 8. A different point is that a connector terminal platform 20 is detachably attached to the DIN rail 10 by one elastic arm portion 31 and one latching projection portion 33 in place of the pair of elastic arm portions 31. By pressing the operation receiving portion 31*a* by the screw driver (not shown) via the guide groove 30 and deforming the elastic arm portion 31, the latching claw portion 32 can be removed from the latching rib 11 of the DIN rail 10.

Further, as described in the above first embodiment, the connector terminal platform 20 can be attached in parallel (FIGS. 6A and 6B) or orthogonal (FIGS. 7 and 8) to the DIN rail 10.

The other portions are the same as described in the above first embodiment. Thus, same parts will be given the same reference numerals and description thereof and is omitted.

According to the present embodiment, rigidity of the latching projection portion 33 is large. Thus, there is an advantage that a support force is large.

A connector terminal platform 20 according to third embodiment is substantially the same as the above first embodiment, as shown in FIGS. 9A to 11. A different point is that an operation receiving portion 34 having a different shape is integrally formed in an intermediate portion of the elastic arm portion 31. The operation receiving portion 34 has a substantially trapezoidal shape, and an upper end surface thereof is exposed from a cutout portion 30*a*. Therefore, by pushing down the upper end surfaces of the operation receiving portions 34, the elastic arm portions 31 are elastically deformed, so that the latching claw portions 32 can be detached from the latching ribs 11, 12 of the DIN rail 10.

Further, as described in the above first embodiment, the connector terminal platform 20 can be attached in parallel (FIGS. 9A and 9B) or orthogonal (FIGS. 10 and 11) to the DIN rail 10.

The other portions are the same as the above first embodiment. Thus, the same parts will be given the same reference numerals and description thereof and is omitted.

A connector terminal platform 20 according to fourth embodiment is substantially the same as the above first embodiment as shown in FIGS. 12A to 14. A different point is that operation receiving portions do not extend from the elastic arm portions 31, and operation receiving portions 35 respectively protruding sideways from outside surfaces are provided in the base 21 and the terminal blocks 27.

Therefore, by pushing down the operation receiving portions 35 by the screw driver (not shown) along the outside surfaces of the base 21 or the terminal blocks 27 and elastically deforming the elastic arm portions 31, the locking claw portions 32, 32 can be removed from the latching ribs 11, 12 of the DIN rail 10.

Further, as described in the above first embodiment, the connector terminal platform 20 can be detachably attached in parallel (FIGS. 12A and 12B) or orthogonal (FIGS. 13 and 14) to the DIN rail 10.

The other portions are the same as the above first embodiment. Thus, the same parts will be given the same reference numerals and description thereof and is omitted.

According to the fourth embodiment, since no guide grooves are provided in the base 21 and the terminal blocks 27, there is an advantage that mechanical strength of the base 21 and the terminal blocks 27 is high.

In the above embodiments, a case where the contact portions are provided in the center parts of the base, is described. However, the contact portions are not necessarily provided in the center but may be provided at decentered positions.

A support rail is not limited to the DIN rail but in the support rail, at least one latching rib may protrude sideways inward.

The attachment structure of the electronic device according to the present invention can be applied not only to the connector terminal platform but also to attachment of other electronic devices such as a gauge and a monitor, as a matter of course.

There has thus been shown and described an attachment structure of an electronic device which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An attachment structure of an electronic device comprising:

a latching claw portion provided on a lower surface of a base of the electronic device;

a latching rib of a support rail, the latching rib for being latched by the latching claw portion during a latching state; and an operation receiving portion of an elastic arm elastically deformable by a push-down operation of the operation receiving portion in a direction towards the support rail, wherein the operation receiving portion is configured to be exposed and visible from an upper surface edge of the base and no portion of the attachment structure resides directly above the exposed operation receiving portion;

wherein the latching claw portion and the operation receiving portion are provided in a leading end of the elastic arm portion extending from the base; and wherein the latching state is releasable by a one touch operation in the direction towards the support rail through the push-down operation of the operation receiving portion, wherein the latching claw portion moves downwards before deforming outward during the push down operation.

2. The attachment structure of the electronic device according to claim 1, wherein the base has four corner portions, the elastic arm portion with the latching claw portion and the operation receiving portion for elastically deforming the elastic arm portion being provided at least at one corner portion.

3. The attachment structure of the electronic device according to claim 1, wherein the latching claw portion and the operation receiving portion are disposed at an intermediate position of facing side surfaces of the base.

4. The attachment structure of the electronic device according to claim 3, wherein the operation receiving portion is provided so as to be pushed down via a guide groove provided on an outside surface of the base.

5. The attachment structure of the electronic device according to claim 3, wherein the operation receiving portion protrudes sideways from an outside surface of the base and elastically deforms the elastic arm portion by the push-down operation of the operating receiving portion.

6. The attachment structure of the electronic device according to claim 3, wherein the base comprises a contact portion abuttable with the latching rib of the support rail at the intermediate position, wherein the latching claw portion and the operation receiving portion of the elastic arm are extending towards the contact portion, and wherein the contact portion is configured to be positioned orthogonally to a section center of the support rail.

7. The attachment structure of the electronic device according to claim 1, wherein the operation receiving portion protrudes sideways from an outside surface of the base and elastically deforms the elastic arm portion by the push-down operation of the operating receiving portion.

8. An attachment structure according to claim 1, wherein the elastic arm is positioned at a location spaced outwardly from the rail, the operating portion extending over an upper surface of the rail and the latching claw portion extending below and engaging a lower surface of the rail in the latching state, wherein the one-touch operation through downward pushing on the operating portion deforms the elastic arm away from the rail and moves the latching claw portion out of the latching state.

9. The attachment structure of the electronic device according to claim 1, wherein the operating receiving operation is provided so as to be pushed down in a direction towards the support rail via a guide groove provided on an outside surface of the base.

10. The attachment structure of the electronic device according to claim 1, wherein the operation receiving portion has a flat surface that is parallel to an upper surface of the base, and wherein the latching state is released by the one touch operation through the push-down operation on the flat surface of the operation receiving portion.

* * * * *